US007735403B2

(12) United States Patent
Oberheim et al.

(10) Patent No.: US 7,735,403 B2
(45) Date of Patent: Jun. 15, 2010

(54) ALIGNMENT SYSTEM FOR A FENCE FOR A TABLE SAW

(75) Inventors: Stephen C. Oberheim, Des Plaines, IL (US); Ravi Voruganti, Lake Barrington, IL (US)

(73) Assignee: Robert Bosch GmbH, Stuttgart (DE)

( * ) Notice: Subject to any disclaimer, the term of this patent is extended or adjusted under 35 U.S.C. 154(b) by 705 days.

(21) Appl. No.: 11/527,042

(22) Filed: Sep. 26, 2006

(65) Prior Publication Data

US 2008/0072728 A1 Mar. 27, 2008

(51) Int. Cl.
*B27B 27/02* (2006.01)

(52) U.S. Cl. ..... 83/441; 83/468; 83/477.2; 83/522.15; 144/253.1; 33/640; 33/641

(58) Field of Classification Search ..... 144/287, 144/253.1, 286.1; 33/613, 640, 641, 645; 83/441, 442, 444, 446, 468, 472, 474, 477, 83/477.2, 522.15, 522.16, 522.17, 522.18, 83/522.22, 522.23, 522.24, 522.25, 581
See application file for complete search history.

(56) References Cited

U.S. PATENT DOCUMENTS

| | | | | |
|---|---|---|---|---|
| 1,362,545 | A * | 12/1920 | Smith | 83/477.2 |
| 3,011,531 | A * | 12/1961 | Gaskell | 83/438 |
| 5,954,106 | A * | 9/1999 | Huang | 144/286.5 |
| 6,295,738 | B1 * | 10/2001 | Risch | 33/700 |
| 6,493,955 | B1 * | 12/2002 | Moretti | 33/451 |
| 6,584,695 | B1 | 7/2003 | Chang | |
| 6,644,156 | B2 * | 11/2003 | Villacis | 83/425 |
| 6,755,107 | B2 | 6/2004 | Peot et al. | |
| 6,786,124 | B1 | 9/2004 | Huang | |
| 7,073,268 | B1 * | 7/2006 | Etter et al. | 33/286 |
| 7,347,133 | B2 * | 3/2008 | Cheng et al. | 83/520 |
| 7,487,599 | B1 * | 2/2009 | Spirito | 33/640 |
| 2003/0010173 | A1 * | 1/2003 | Hayden | 83/520 |
| 2005/0198845 | A1 * | 9/2005 | Robinson | 33/227 |
| 2006/0065087 | A1 * | 3/2006 | Griswold et al. | 83/13 |
| 2006/0106482 | A1 * | 5/2006 | Etter et al. | 700/180 |

FOREIGN PATENT DOCUMENTS

| | | | |
|---|---|---|---|
| GB | 2359040 | * | 8/2001 |

* cited by examiner

*Primary Examiner*—Boyer D. Ashley
*Assistant Examiner*—Edward Landrum
(74) *Attorney, Agent, or Firm*—Greer, Burns & Crain, Ltd.

(57) ABSTRACT

Embodiments of an alignment system for a table saw are disclosed, wherein the table saw has a rotatable blade that extends through its table top, the table top having spaced indicia oriented in a direction parallel to the plane of the blade, comprising an elongated fence having first and second end portions, at least the first end portion having a mechanism for securing the fence on the table saw, an elongated portion attached to the first end portion and extending over the table top, the fence being normally oriented so that the elongated portion is parallel to the plane of the blade and being laterally adjustable relative to the blade, at least two light emitting units mounted on the fence at spaced locations along the length of the fence, each unit configured to direct light on a first side of the fence toward the indicia and enable an observer to determine if the fence is oriented parallel to the indicia.

13 Claims, 5 Drawing Sheets

ALIGNMENT SYSTEM FOR A FENCE FOR A TABLE SAW

BACKGROUND OF THE INVENTION

The present invention generally relates to power tools. More particularly, the present invention relates to power tools which utilize a fence for guiding work pieces during operation of the tool.

It has long been known that table saws as well as other saws and power tools have utilized fences for guiding work pieces during a cutting or similar operation. The fences are typically adjustable to accommodate variously dimensioned work pieces or to vary the amount of material that is being cut. Such fences are almost essential for cutting boards or sheet of material as they are being fed to the saw blade of table saw. Of course, fences are used for similar control with regard to many other kinds of power tools such as routers and shapers, miter saws, radial arm saws and the like.

Most table saws generally have a fence which is completely removable fence and which extends completely from the front to the back of the table top and include a clamping mechanism that is typically designed for the particular table saw so that it can be laterally adjusted to a desired position and clamped down. Also, most table saws have a runner, rail or other structure attached to the front of the table saw on which the fence can ride and when it is clamped down, the clamping end has a surface which will engage a complimentary surface of the rail so that an elongated fence portion is oriented in a direction that is perpendicular to the rail. However, many modern fences have the clamping end mechanism that is separately manufactured and is then attached to an elongated portion. Because they are separate pieces which are interconnected and can become misaligned, it is desirable to be able to calibrate the fence and adjust it so that the elongated portion is exactly perpendicular to clamping end mechanism, and the front rail. When the calibration is successfully completed, the elongated portion is also substantially parallel or true to the plane of the blade of the table saw.

If very close tolerances are desired in the cutting of work pieces, it is important for a user to be able to check to insure that the fence is accurately aligned. While it is possible to place lines or grooves in the table top to provide a reference of parallelism to the plane of the blade, uncertainty can remain as to whether the fence is true or not. An inexpensive system for determining and achieving true and accurate alignment is desirable.

SUMMARY OF THE INVENTION

Embodiments of an alignment system for a table saw are disclosed, wherein the table saw has a rotatable blade that extends through its table top, the table top having spaced indicia oriented in a direction parallel to the plane of the blade, comprising an elongated fence having first and second end portions, at least the first end portion having a mechanism for securing the fence on the table saw, an elongated portion attached to the first end portion and extending over the table top, the fence being normally oriented so that the elongated portion is parallel to the plane of the blade and being laterally adjustable relative to the blade, at least two visual indicating devices located on at least one side of said fence at spaced locations along the length of said fence to enable an observer to determine if said fence is oriented parallel to the indicia.

A preferred embodiment of the visual indicating devices comprises light emitting units mounted on the fence at spaced locations along the length of the fence, each unit configured to direct light on a first side of the fence toward the indicia and enable an observer to determine if the fence is oriented parallel to the indicia. Another preferred embodiment of the visual indicating devices comprises sighting elements having a flat surface oriented relative to said side of said fence enabling the observer to view the table top along the plane of the flat surface and determine the location where the plane of the flat surface visually impinges the table top relative to the indicia

DETAILED DESCRIPTION

Broadly stated, the present invention is directed to a fence that is provided with visual indicating devices located on at least one side of said fence at spaced locations along the length of said fence to enable an observer to determine if said fence is oriented parallel to the indicia. A preferred embodiment utilizes light emitting units that are placed on the underside of the fence which emit a narrow beam of light that is directed downwardly toward the table top and which, because of the calibration thereof, enables a user to determine whether the elongated narrow center portion of the fence is properly oriented or true. In other words, the elongated portion of the fence that extends over the table top should be accurate in that it should be parallel to the plane of the blade. This will enable a user to rely upon the use of a fence to guide work pieces through the saw so that they that are accurately cut, since the function of a fence is to provide a surface against which a work piece can be placed and moved through the cutting area during use.

Embodiments of the present invention use at least two spaced apart narrow beams of coherent light, which are preferably provided by lasers, and which are directed downwardly onto the surface of the table top to provide two small points or lines of light adjacent at least one of the sides of the elongated portion of the fence. The points or lines of light are compared to indicia such as a plurality of narrow grooves, painted lines or a combination of both, oriented in a direction parallel to the plane of the blade enables the user to compare the position of the points or lines of light and determine whether the elongated portion of the fence is substantially parallel to the indicia and therefore will result in accurate cuts of work pieces that are cut by the saw.

Since fences are generally laterally adjustable and movable so that they can be placed on either side of the saw blade, it is desirable to have such light emitting units positioned on both sides of the fence so that the spaced points or lines of light can be observed on either side of the fence relative to the indicia. This would enable the user of the saw to compare the location of the spaced points or lines of light to the indicia on one side of the fence even if the work piece is placed next to the fence in position for cutting.

Figure 1:
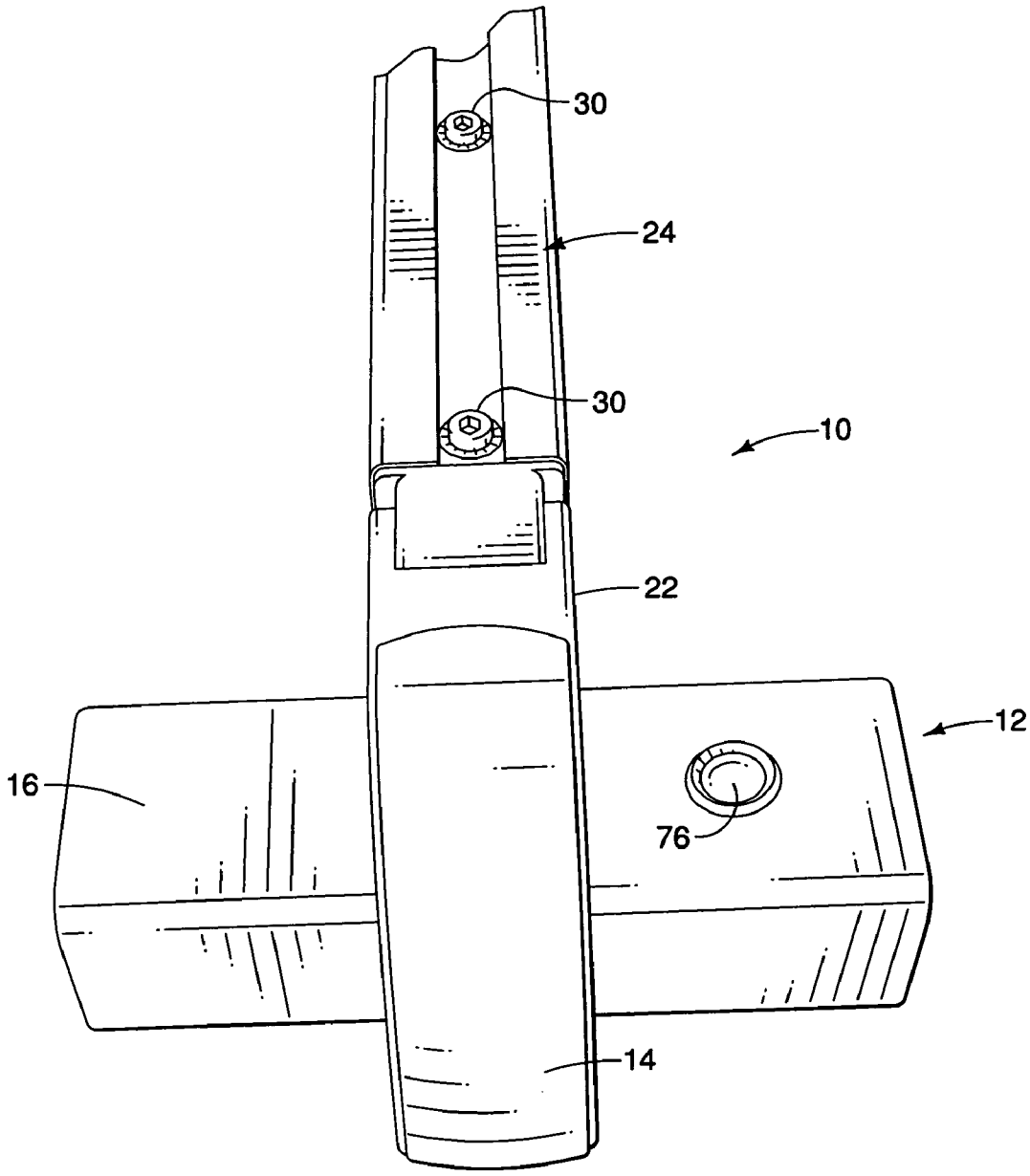
FIG. 1 is a perspective front view of the preferred embodiment of the present invention, and particularly illustrating a portion of a fence.

Turning now to the drawings and particularly FIG. 1, a fence embodying a first preferred embodiment of the present invention is indicated generally at 10 in FIG. 1, and includes a front clamping portion, indicated generally at 12, that has a clamp handle 14 and a wide L shaped support portion 16 that cooperates with a rail, groove or like (not shown) that is provided across the front of the table saw as is known to those of ordinary skill in the art.

Figure 2:
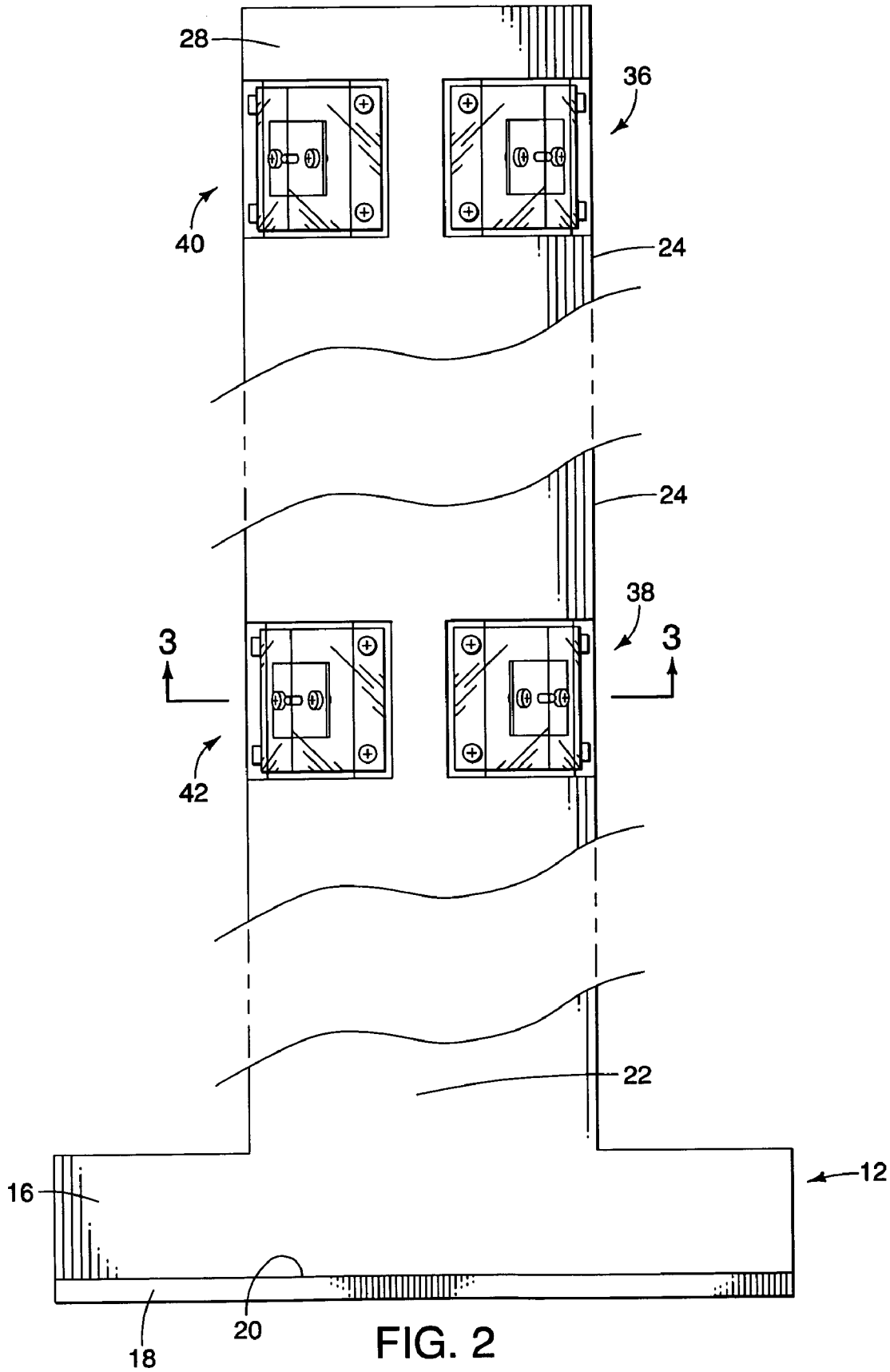
FIG. 2 is an idealized bottom view of the preferred embodiment of the present invention.

Referring to the bottom view of FIG. 2, the support portion 16 has a transverse flange 18 which presents a shoulder 20 for engaging a rail or the like as previously described. The clamping portion 12 has a narrower extension 22 which supports the clamp handle 14 and also is configured to connect to an elongated center portion 24 that generally extends from the front of the table top 26 (see FIG. 3) to its rear. A rear end portion 28 may be provided with another clamp mechanism for insuring that both ends of the fence are maintained in position during operation of the saw When the clamp handle 14 is pushed down as shown in FIG. 1, the fence 10 is secured in lateral position relative to a blade 28 (see FIG. 3). If the elongated center portion 24 of the fence is properly aligned to be perfectly perpendicular to the surface 20 (FIG. 2), then it will function properly and enable accurate cuts to be made on a work piece. However, it is typical that a fence be made of several components may use a metal extrusion such as shown in FIG. 1 for the elongated outer portion and it may be angularly adjusted to correct for manufacturing tolerances, for example and for this reason, a pair of screws 30 may be provided to adjust the angle of elongated center portion 24 relative to the support portion 16 of the front clamping portion 12 of the fence 10. This is preferably capable of being angularly adjusted a few degrees which is usually sufficient to achieve true angular perpendicularity relative to the support portion 16.

As shown in the bottom view of FIG. 2, there are four separate visual indicating devices, which in this embodiment are light emitting units, indicated generally at 36, 38, 40 and 42, that are located on the bottom and sides of the center portion 24. The front and rear units are preferably spaced apart from one another a substantial distance to enable a more accurate determination of whether the elongated portion 24 is accurately perpendicular to the clamping portion and more particularly, the surface 20 thereof. The is because any misalignment will be magnified or exaggerated if the distance between the two points or lines of light is increased.

It should be understood that the exact construction and operation of the clamping portion 12 including the clamp handle 14 and the construction of the center portion 24 of the fence can vary inasmuch as the present invention is directed to features and functionality that is associated with the fence, and the fence that is described and illustrated herein merely provides an environment for the present invention. In this regard, while the cross-section of the center portion 24 is shown as a solid in FIG. 3, it should be understood that this could be a relatively thin walled extrusion or a combination of parts that make up the center portion 24.

Figure 3:
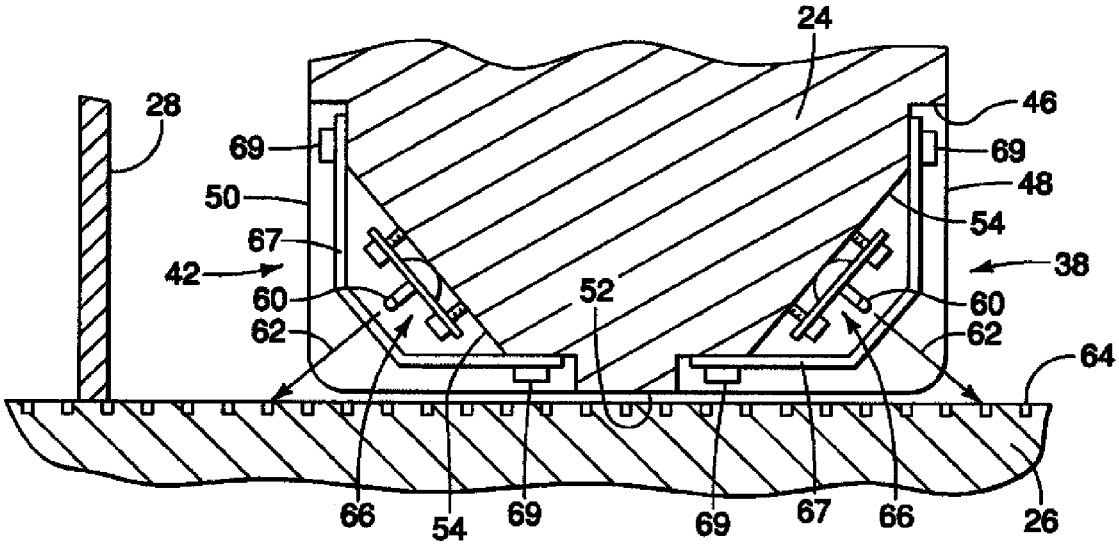
FIG. 3 is a section taken generally along the line 3-3 of FIG. 2.

Regardless of the construction of this center portion 24, and as shown in FIG. 3, each of the light emitting units is positioned in a recess 46 that is provided into one of the sides 48 or 50 as well as extending along the bottom 52. As is common practice, the fence 10 has its bottom surface slightly spaced from the top surface of the table top 26. The recess 46 also has an angled surface 54 that is shown to be approximately 50° although it may be at a less or greater angle as will be described. It should be understood that if the portion 24 is made from a thin walled extrusion, then there may be an additional casting or sheet metal that would provide support surfaces such as the angled surface 54 as is apparent to those of ordinary skill in the art.

Each of the light emitting units 36, 38, 40 and 42 have a laser 60 that emits a narrow beam of light that results in a point where it impinges on the surface of the table top 26. The lasers 60 are preferably laser LEDs that emit a narrow beam of light 62 which is directed at an angle of approximately 50° as shown in FIG. 3, although the angle may be within the range of about 45° to about 65°. Also, although laser LEDs are preferred, it should be understood that other light sources and arrangements can be used. For example, regular LED's or incandescent light sources may be used in conjunction with lenses or a slotted mask.

A consideration of the angle of the beam 62 is that the larger the angle relative to vertical, the smaller the angle will be relative to the horizontal surface 54. The smaller angle relative to the surface 54 causes what would be a spot of light on the surface from a vertical source to become more elliptical at a flatter angle. This can detrimentally affect a user's ability to accurately determine whether the fence is properly aligned.

The angle may be preset so that it impinges at a point that is spaced away from the side 48 of the center portion 24 so that it can be easily viewed by an observer. Also, as shown in FIG. 3, the table top has lines 64 that are spaced apart from one another across the top surface of the table top 26, which are provided by the table saw manufacturer and are highly accurate in that they are parallel to the plane of the blade 28. While they are shown to have some depth and may in fact be grooves that are either filled with paint or not, it should be understood that they may be made in various ways and have various appearances while accomplishing their intended purpose. In this regard, such indicia may also be in the form of a grid with the grid including lines that are parallel to the plane of the blade 28 as well as cross lines that are perpendicular thereto.

The purpose of the lines 64 is to provide a reference for comparing the point beams or lines 62 from the rear unit 36 and the front unit 38 that impinge on or near one of the lines 64, which enables a user to determine whether the fence is in or out of alignment. In this regard, there should be a sufficient number of lines 64 so that the observer can closely determine the position of spots or lines produced by the front as well as the rear units relative to a single line so that the observer can make a comparison and determine whether they are at the same position relative to the line.

Figure 4:
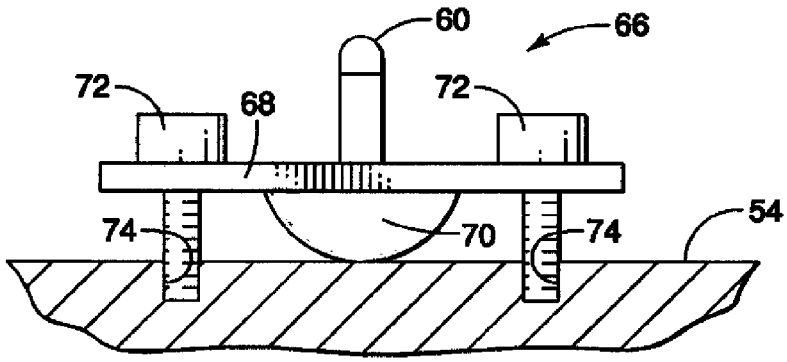
FIG. 4 is an enlarged side view of a portion of the preferred embodiment shown in FIG. 3.
Figure 5:
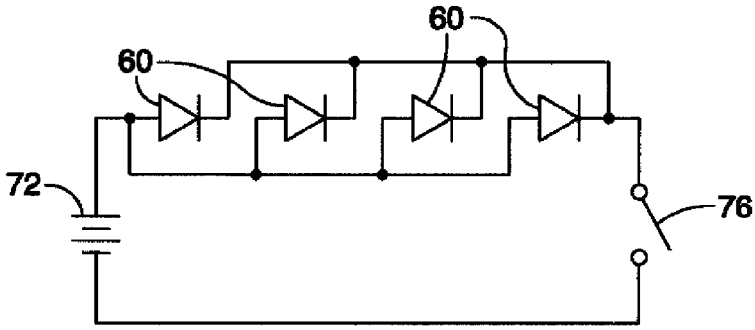
FIG. 5 is a simplified electrical schematic diagram of the fence shown in FIGS. 1-4.

Since the beam 62 that is emitted from the laser in a front unit 38 should be at the same angle as that from the rear unit 36, it should be understood that laser 60 in each unit must be carefully calibrated and that is preferably done when the fence is manufactured. Each of the lasers is attached to the elongated portion 24 by a rocker mount mechanism, indicated generally at 66, which is shown in detail in FIG. 4. The laser LED 60 is attached to a generally flat plate 68 that has a semi-cylindrical lower portion 70 attached to or formed with the underside of the plate 68. The semi-cylindrical portion 70 is shown to be nearly a half cylinder, but may be less or greater than that shown, the important consideration being that the convex outer portion contacts the surface 54, and enables the plate 68 to be angularly adjusted relative to the surface 54 by virtue of two screws 72 that extend through the plate 68 into apertures 74 in the surface 54. By rotating the two screws in opposite directions, the plate 68 can be tilted with the left side moving closer than the right side, for example, thereby tilting the laser 60 and its directed beam of light. The cylindrical portion 70 may be hollow to accommodate the LED laser 60 which can extend through an aperture in the plate 68 or the laser may be mounted directed to the plate 68. The exact construction is determined by the laser configuration. It should also be understood that while a semi-cylindrical configuration is shown, other curved shapes as well as a point contact may be employed. Also, other types of mounting mechanisms that permit such calibrating adjustment may be used.

Each of the lasers 60 in the units 36, 38, 40 and 42 is preferably protected by a transparent cover 67 made of Plexiglass or other strong transparent plastic, that has a generally L-shaped configuration, with a flat corner portion that is preferably perpendicular to the beam 62 that is directed toward the surface of the table top 26. The cover 67 is preferably attached to the sides and bottom center portion 24 with screws or bolts 69.

It should also be understood that the rocker mount mechanism 66, in addition to calibrating the front unit 38 relative to the rear unit 36, can also adjust the angle of the beam 62 produced by the laser 60. Also, a combination of determining the angle of the surface 54 together with the adjustability of the rocker mount mechanisms 66 enables the angle of the beams to be positioned and calibrated.

The lasers 60 are preferably powered by a battery 72 that may be located in the support portion 16 of the front clamping portion 12 and a pushbutton switch 76 may also be located therein. However, the battery may alternatively be installed in the elongated portion 24. The battery and switch 76 are series connected to the four parallel connected laser LED's 60 and activated when the pushbutton is depressed. While not shown, the pushbutton may have a mechanical capability to maintain electrical contact for a predetermined time or electronic circuitry can be used to introduce a delay so that the laser LED's stay on for some predetermined time. Alternatively, the switch 76 may be of the type which requires a push on and subsequent push off operation to toggle between the on and off positions. Alternatively, other types of toggle switches may be used.

It should be understood that while having light emitting units on opposite sides of the fence enables an observer to determine the trueness of the fence from either set of light emitting units, it should be understood that such a trueness determination can be made with only light emitting units being provided on one side.

Figure 6:
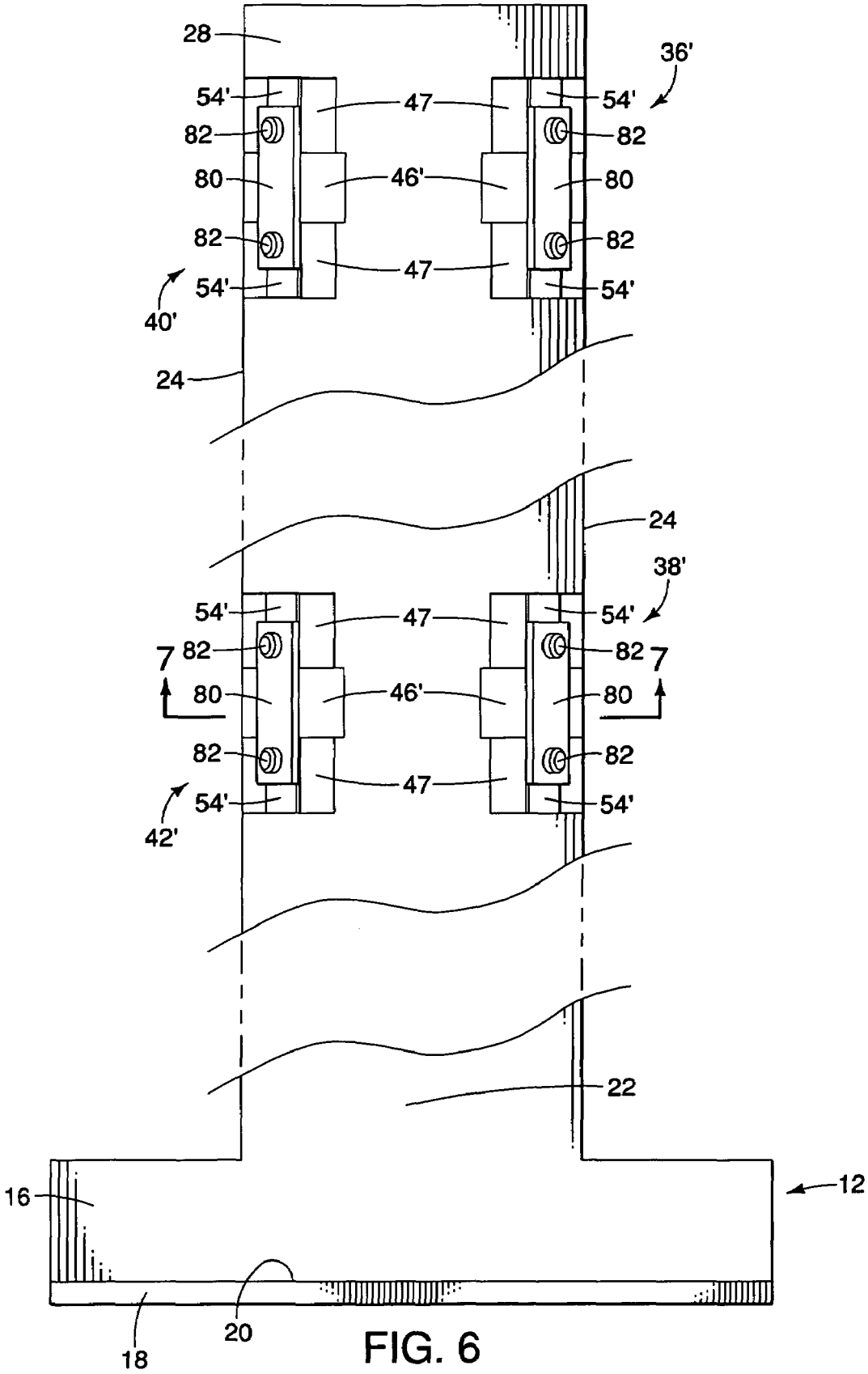
FIG. 6 is a view similar to FIG. 2 and illustrating an alternative embodiment of the invention.
Figure 7:
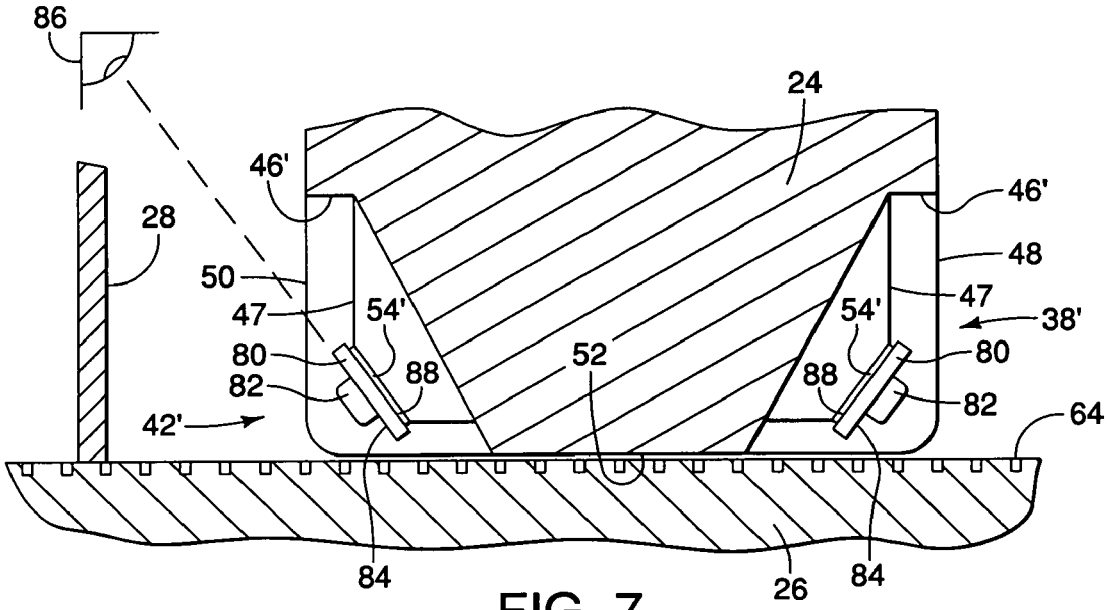
FIG. 7 is a cross section taken generally along the line 7-7 of FIG. 6.

An alternative preferred embodiment is shown in FIGS. 6 and 7, which are similar to the views shown in FIGS. 2 and 3, respectively. Where indicated, the reference numbers from FIGS. 2 and 3 are intended to identify the same components and features in this embodiment, and the use of the same numbers with a prime designation is intended to indicate similar components and features as shown in FIGS. 2 and 3. This embodiment has four visual indicating devices 36', 38', 40' and 42', wherein the devices are mounted in recesses 46', with the recesses having opposite end portions with shoulder portions 47 that have an angled surface 54' for mounting an elongated sighting element 80. The sighting element 80 is attached to the angled surface 54' by a pair of bolts or screws 82, although other types of fasteners or attachment means could be used.

The sighting element 80 can be made from a transparent plastic or plastic-like material or it can be made from metal. It has a flat outer surface 84 so that an observer 86 can sight across the surface 84 and determine where the sight line would intercept the table top 64 and determine that intercept point relative to the indicia on the table top. The angle of the surface 54' determines the angle at which the observer 86 sights along the surface 84 and is not particularly critical as long as it is a convenient position relative to other portions of the saw and is easily accessible. However, it is very important that the angle of the surface 84 of the sighting element 80 of the devices 40' and 42', (as well as devices 36' and 38') be identical so that the observer can determine whether the fence is parallel with the indicia, i.e., the sight lines relative to indicia are the same at both front and back positions. To this end, a shim 88 may be provided between the sighting element 80 and the angled surface 54' to enable one or both of the devices 40' and 42' (as well as devices 36' and 38') to be calibrated. The thickness of the shim may be varied to achieve accurate calibration, and therefore is preferably done during the manufacturing process.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. An adjustable fence for use with a table saw, wherein the table saw has a rotatable blade that extends through an aperture of a table top, the table top having indicia that provides a reference of parallelism to the plane of the blade, said fence having at least two recesses in the side and bottom thereof, each having an angled surface configured to have a rocker mechanism attached thereto, said fence comprising:

a front clamping portion having a mechanism for securing said fence on the table saw;

an elongated portion attached to said clamping portion and extending from the front to the back of the table top, said elongated portion being substantially parallel to the plane of the blade;

at least two visual indicating devices positioned on at least one side of said fence at spaced locations along the length of said fence, said devices enabling an observer to compare the lateral position of the fence at each location relative to the indicia and determine if said elongated portion is substantially parallel to the indicia, said visual indicating devices comprise at least two light emitting laser LED units mounted on respective adjustable rocker mechanisms that are mounted on said fence at spaced locations along the length of said fence, each laser LED unit being configured to direct a narrow beam of light beam a predetermined distance from a first side of said fence toward the indicia and enable an observer to compare the location of each point relative to the indicia and determine if said elongated portion is substantially parallel to the indicia.

2. An adjustable fence as defined in claim 1 wherein said rocker mechanism comprises a plate member to which said laser LED is mounted, said plate member having a partial cylindrical shaped portion for contacting said angled surface, and means for adjusting the angular orientation of said plate member relative to said angled surface to adjust the direction of said narrow beam of light beam that is emitted by said laser LED.

3. An adjustable fence as defined in claim 1 further comprising at least two light emitting units mounted on said fence at spaced locations along the length of said fence, each unit being configured to direct a narrow beam of light beam a predetermined distance from a second side of said fence toward the indicia and enable an observer to compare the location of each point relative to the indicia and determine if said elongated portion is substantially parallel to the indicia.

4. An adjustable fence as defined in claim 1 wherein said light emitting units are located at opposite end portions of said fence.

5. A table saw, comprising a rotatable blade that extends through an aperture of a table top, the table top having spaced indicia oriented in a direction parallel to the plane of the blade, and an alignment system, said alignment system comprising:

an elongated fence having first and second end portions, at least said first end portion having a mechanism for securing said fence on the table saw, an elongated portion attached to said first end portion and extending over the table top, said fence being normally oriented so that said elongated portion is parallel to the plane of the blade and being laterally adjustable relative to the blade said fence has a recess in the side and bottom thereof with an angled surface to which a rocker mechanism is attached;

at least two visual indicating devices located on at least one side of said fence at spaced locations along the length of said fence to enable an observer to determine if said fence is oriented parallel to the indicia, wherein said visual indicating devices comprise at least two light emitting units mounted on said fence at spaced locations along the length of said fence, each unit configured to direct light on a first side of said fence toward the indicia and enable an observer to determine if said fence is oriented parallel to the indicia, each of said light emitting units comprising a laser LED configured to emit a beam of coherent light onto the table top at a predetermined distance from the side of said fence;

wherein said laser LED is mounted on an adjustable rocker mechanism that is attached to said fence, said rocker mechanism comprising a member to which said laser LED is mounted, said member having a generally curved convex surface for contacting said angled surface, and means for adjusting the angular orientation of said convex surface relative to said angles surface to adjust the direction of the light beam that is emitted by said laser LED.

6. A table saw as defined in claim 5 wherein said adjusting means comprises at least two screws on opposite sides of said convex surface that are threaded into apertures on said angled surface.

7. A table saw as defined in claim 5 wherein said convex surface is at least a portion of a generally cylindrical shape.

8. A table saw as defined in claim 5 further comprising at least two light emitting units mounted on said fence at spaced locations along the length of said fence, each unit configured to direct light on a second side of said fence toward the indicia and enable an observer to determine if said fence is oriented parallel to the indicia.

9. A table saw as defined in claim 5 wherein the indicia comprises a plurality of spaced apart parallel lines that extend across the table top.

10. A table saw as defined in claim 5 wherein each of said light emitting units further comprising an outer transparent cover.

11. A table saw as defined in claim 5 wherein said member comprises a generally flat plate.

12. A table saw as defined in claim 5 further comprising a source of power installed in said fence for powering said light emitting units and circuitry including a switch for connecting said source of power to said light emitting units.

13. A table saw as defined in claim 12 wherein said circuitry is operative to supply power to said light emitting units for a time period after said switch is activated.

* * * * *